US008997930B2

(12) United States Patent
Moss et al.

(10) Patent No.: US 8,997,930 B2
(45) Date of Patent: Apr. 7, 2015

(54) LADDERS, LADDER COMPONENTS, LADDER ACCESSORIES, LADDER SYSTEMS AND RELATED METHODS

(75) Inventors: N. Ryan Moss, Mapleton, UT (US); Ryan Crawford, Spanish Fork, UT (US); Ben K. Jackson, Santaquin, UT (US); Stephen E. Boynton, Spanish Fork, UT (US); Heidi Phillips, Sugarland, TX (US); Keith Emmel, Orem, UT (US)

(73) Assignee: Wing Enterprises, Inc., Springville, UT (US)

( * ) Notice: Subject to any disclaimer, the term of this patent is extended or adjusted under 35 U.S.C. 154(b) by 513 days.

(21) Appl. No.: 12/774,637

(22) Filed: May 5, 2010

(65) Prior Publication Data

US 2010/0282540 A1 Nov. 11, 2010

Related U.S. Application Data

(60) Provisional application No. 61/175,731, filed on May 5, 2009.

(51) Int. Cl.

| | |
|---|---|
| ***E06C 7/00*** | (2006.01) |
| ***E06C 7/16*** | (2006.01) |
| ***B25H 1/06*** | (2006.01) |
| ***E04G 1/30*** | (2006.01) |
| ***E06C 7/14*** | (2006.01) |

(52) U.S. Cl.
CPC .. *E06C 7/16* (2013.01); *B25H 1/06* (2013.01); *E04G 1/30* (2013.01); *E06C 7/14* (2013.01)

(58) Field of Classification Search
USPC ..... 182/129, 119–120; 248/210, 211, 238, 248/221.11; 15/257.05, 257.6; 220/482, 220/765, 766, 768, 773, 775, 776, 480, 478, 220/570
See application file for complete search history.

(56) References Cited

U.S. PATENT DOCUMENTS

| | | | | | |
|---|---|---|---|---|---|
| 2,069,969 | A | | 2/1937 | Nelson | |
| 2,101,245 | A | | 12/1937 | De Franco | |
| 2,908,468 | A | * | 10/1959 | Thomas | 248/210 |
| 3,394,425 | A | * | 7/1968 | Welt | 15/257.06 |
| 3,602,939 | A | * | 9/1971 | Schoenholz | 15/257.06 |
| 4,424,949 | A | * | 1/1984 | Kimmett et al. | 248/238 |
| 4,480,810 | A | * | 11/1984 | Hall | 248/238 |
| 4,505,390 | A | * | 3/1985 | Kirk, Jr. | 206/547 |
| 4,589,521 | A | * | 5/1986 | Finster et al. | 182/129 |

(Continued)

FOREIGN PATENT DOCUMENTS

| | | |
|---|---|---|
| GB | 2410525 | 3/2005 |
| JP | 60 194033 | 12/1985 |

OTHER PUBLICATIONS

Partial International Search Report for PCT International Application No. PCT/US2010/033769, mailed Aug. 3, 2010.

*Primary Examiner* — Daniel Cahn
(74) *Attorney, Agent, or Firm* — Holland & Hart, LLP

(57) ABSTRACT

Various embodiments of ladders, ladder components, accessories for ladders, ladder systems and related methods are provided. In one embodiment a ladder and platform system is provided having at least two ladders and a platform or plank. The platform or plank has coupling mechanisms that provide adjustable but secure coupling of the platform to the ladders, either with the top cap or with the rungs. Other embodiments include storage devices and paint trays for use with ladders and ladder systems incorporating such devices.

7 Claims, 9 Drawing Sheets

(56) References Cited

U.S. PATENT DOCUMENTS

| | | | | | |
|---|---|---|---|---|---|
| 4,593,833 | A * | 6/1986 | Hill | 220/759 |
| 4,643,274 | A * | 2/1987 | Tataseo | 182/106 |
| 5,276,943 | A * | 1/1994 | Ludy | 16/445 |
| 5,342,008 | A * | 8/1994 | Kay | 248/238 |
| 5,511,753 | A * | 4/1996 | Lage | 248/238 |
| 5,823,385 | A * | 10/1998 | Cautereels | 220/762 |
| 5,836,043 | A * | 11/1998 | Rovas | 15/257.06 |
| 5,865,409 | A * | 2/1999 | Nimer | 248/210 |
| 5,899,420 | A * | 5/1999 | Gerardi | 248/146 |
| 6,412,601 | B1 * | 7/2002 | Schmidt | 182/129 |
| 6,474,607 | B1 * | 11/2002 | Wilson | 248/211 |
| 6,698,548 | B1 | 3/2004 | Verrill | |
| 6,783,103 | B2 * | 8/2004 | Salani | 248/211 |
| 7,178,633 | B2 * | 2/2007 | Angotti | 182/129 |
| 7,370,726 | B1 * | 5/2008 | Chavez | 182/129 |
| 8,181,925 | B1 * | 5/2012 | Miville | 248/210 |
| 2001/0052437 | A1 * | 12/2001 | MacSweeney et al. | 182/129 |
| 2002/0104709 | A1 * | 8/2002 | Hines | 182/129 |
| 2005/0056754 | A1 * | 3/2005 | Salani | 248/309.1 |
| 2006/0137937 | A1 * | 6/2006 | Pratt | 182/129 |
| 2006/0192063 | A1 * | 8/2006 | Angotti | 248/210 |
| 2007/0284191 | A1 * | 12/2007 | Astor et al. | 182/129 |

* cited by examiner

LADDERS, LADDER COMPONENTS, LADDER ACCESSORIES, LADDER SYSTEMS AND RELATED METHODS

CROSS-REFERENCE TO RELATED APPLICATIONS

This Application claims the benefit of U.S. Provisional Application No. 61/175,731 filed on May 5, 2009, entitled LADDERS, LADDER COMPONENTS, LADDER ACCESSORIES, LADDER SYSTEMS AND RELATED METHODS, the disclosure of which is incorporated by reference herein in its entirety.

TECHNICAL FIELD

The present invention relates generally to ladders, ladder components, accessories for ladders, ladder systems and related methods

BACKGROUND

Ladders are conventionally utilized to provide a user thereof with improved access to elevated locations that might otherwise be difficult to reach. Ladders come in many sizes and configurations, such as straight ladders, straight extension ladders, stepladders, and combination step and extension ladders. So-called combination ladders may incorporate, in a single ladder, many of the benefits of other ladder designs.

Additionally, various accessories are utilized with ladders to make ladders more efficient, more effective, or to otherwise enhance a user's experience in using a ladder. For example, planks or other structures are sometimes combined with two or more ladders to act as a platform or scaffolding. For example, so-called ladder jacks are often utilized in conjunction with a pair of ladders to provide a support for one or more wooden planks (e.g., 2×10 or 2×12 planks). Such a configuration enables a user to work on a platform of a defined width rather than having to move a ladder multiple times. However, breaking down or disassembling such a configuration, moving all of the components and then setting them up again can be time consuming and require considerable effort.

Another ladder accessory is one which provides storage for, and ready access to, a desired resource while one is working on a ladder. For example, it is often desirable to keep multiple tools readily accessible while on a ladder. However, ladders don't typically have much storage space for many tools or other items. Step ladders, for example, may have a limited surface on the top cap for placing a tool or other resource, but such is extremely limited in space. Extension ladders, on the other hand, typically have no space for storing tools or supplies. Thus, for example, when one is using a ladder for painting, it is desirable to keep a source of paint close by, but it is awkward to try and keep a conventional paint bucket or roller tray on a ladder.

Moreover, while the top cap of a stepladder provides a limited amount of storage space for one's tools or supplies (as mentioned above), when one uses a combination ladder, no such top cap is available for even that limited storage space.

As such, the industry is continually looking for ways to improve the experience of using a ladder and to provide ladders, ladder systems and related components and accessories that make the use of ladders more efficient and effective.

BRIEF SUMMARY OF THE INVENTION

The present invention relates generally to ladders, ladder components, accessories for ladders, ladder systems and related methods.

In accordance with one embodiment of the present invention, a system is provided comprising at least two step ladders and a platform. The platform includes a body portion and at least two coupling mechanisms for coupling with the at least two step ladders. Each coupling mechanism includes at least one bracket fixedly coupled to the body portion and at least one other bracket movably coupled to the body portion.

In accordance with another embodiment, another system is provided including at least two step ladders and a platform having a body portion and at least two coupling mechanisms. Each coupling mechanism comprises at least one bracket fixedly coupled to the body portion, at least one other bracket movable coupled to the body portion, a lever pivotally coupled with the body portion, and a linkage member coupled between the lever and the at least one other bracket. The lever is configured to be displaced from a first position to a second position and, when in the second position, is substantially flush with a working surface of the body portion of the platform.

In accordance with another embodiment of the present invention, a storage device for use with a ladder is provided. The storage device includes a main body portion formed of a flexible fabric and having two opposing sides defining in part an opening at a top of the main body portion. Each of a pair of brackets are coupled to a different one of the two opposing sides of the main body portion. Each bracket is sized and configured to selectively engage a rung of a ladder, wherein the main body portion is configured to collapse such that two brackets are displaced towards each other when the main body portion is in a collapsed state.

In accordance with yet another embodiment of the present invention, a storage device for use with a multipurpose ladder lacking a top cap is provided. The storage device comprises a main body portion formed of a flexible fabric and a pair of brackets coupled with the main body portion. Each bracket is sized and configured to engage one of two adjacent rungs of opposing rail assemblies of the multipurpose ladder, wherein the main body portion is configured to collapse when the opposing rail assemblies of the ladder are folded against one another.

In accordance with a further embodiment of the present invention, a ladder system is provided. The ladder system includes a ladder having a first assembly and a second assembly, the first and second assemblies being pivotally coupled with one another. A storage device has a main body portion formed of a flexible fabric and includes two opposing sides defining in part an opening at a top of the main body portion. A first side of the two opposing sides is coupled with a rung of the first assembly and wherein a second side of the two opposing sides is coupled with a rung of the second assembly.

In accordance with another embodiment of the present invention, a paint tray for use with one or more ladders is provided. The paint tray includes a body portion defining a volume for containing a liquid therein. Each of a pair of brackets is selectively coupled with the body portion in at least two positions including a first position wherein the bracket exhibits a first orientation relative to the body portion and a second position wherein the bracket exhibits a second orientation relative to the body portion, the second orientation being different than the first orientation.

In accordance with yet a further embodiment of the present invention, another paint tray for use with one or more ladders is provided. The paint tray includes a body portion and a pair of brackets. Each bracket comprises a first member coupled with the body portion and a second member selectively coupled with the first member such that, when in a first position, the first member and second member form an angle relative to one another that is greater than 90° and, when in a second position, the first member and the second member form an angle relative to one another that is less than 90°.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
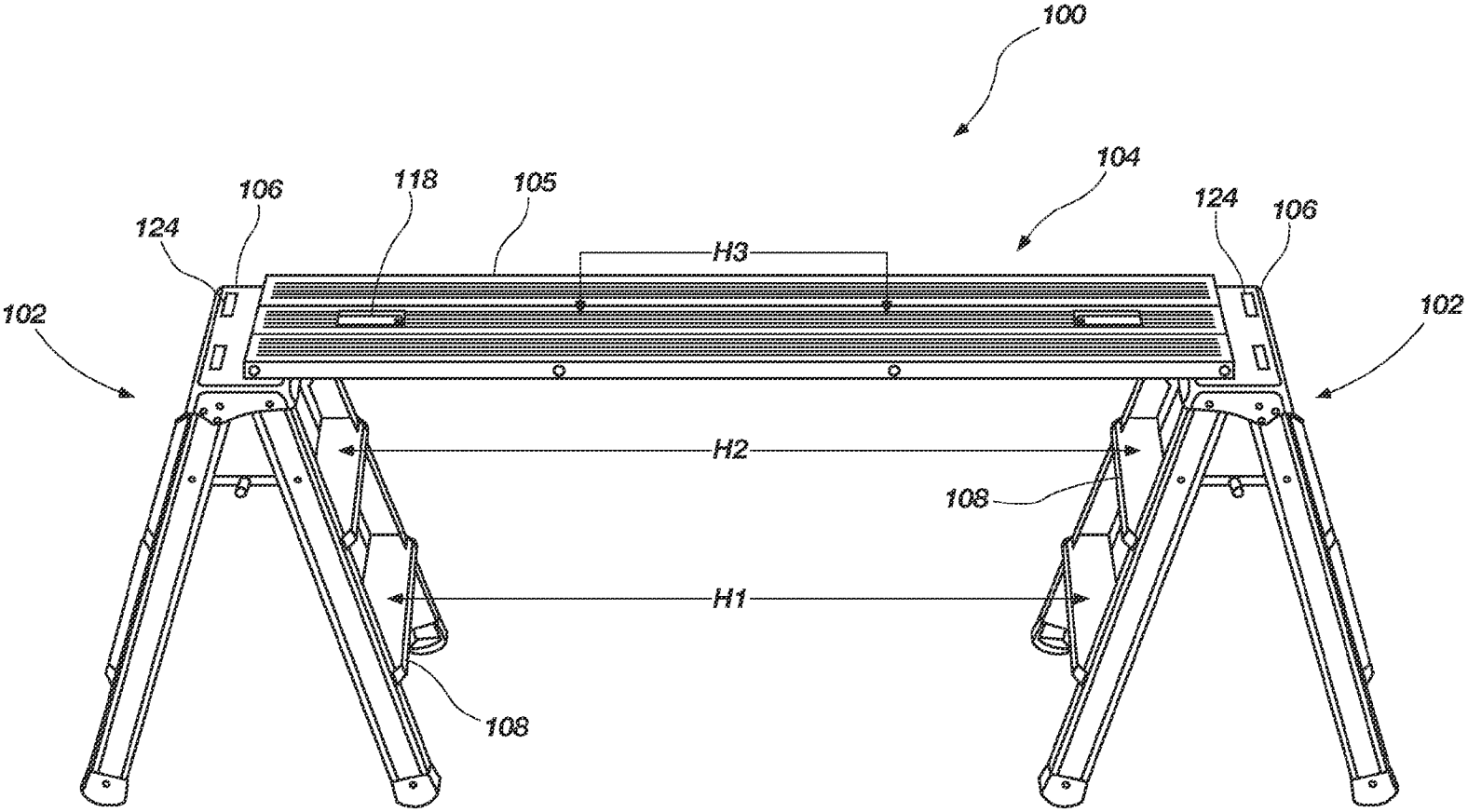
FIG. 1 is a perspective view of a ladder system according to an embodiment of the invention.
Figure 2:
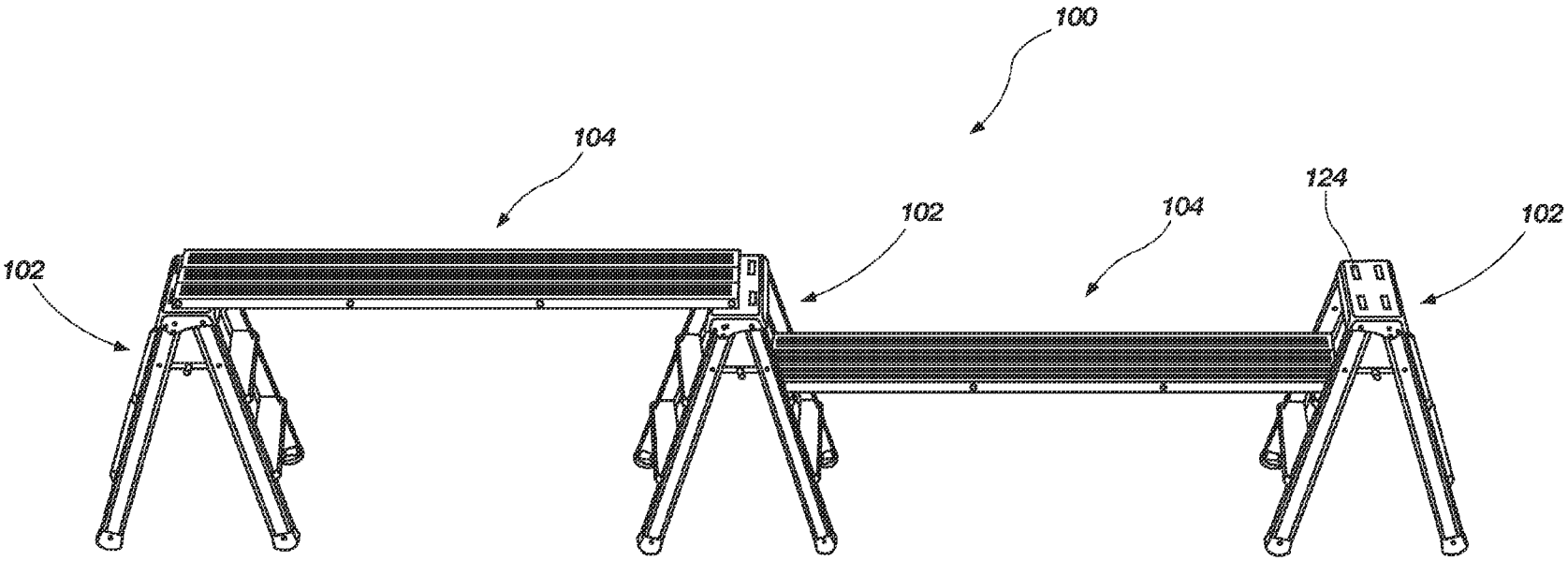
FIG. 2 is a perspective view of a ladder system according to another embodiment of the invention.

Referring generally to FIGS. 1 and 2, a ladder and platform system 100 is shown and described. The system 100 includes, for example, two or more base members configured as step ladders 102, and one or more planks 104 or other structures coupled with the ladders 102. The planks 104 provide a working surface to support a user at an elevated position while working or performing some other activity. Use of a plank 104 or similar structure for a working surface provides a user with increased mobility and movement while at the elevated position compared to the use of only a ladder. In one embodiment, the body 105 of the planks 104 may be, for example, formed of an aluminum material. In other embodiments, other metals or metal alloys may be used. Additionally, other materials, including wood, composites, or combinations of various materials may be used to form the body 105 of the planks 104.

The planks 104 are selectively coupled to the ladders 102 so as to enable a plank to be positioned at a plurality of heights relative to an underlying supporting surface (e.g., the ground) as indicated by the references H1, H2 and H3 in FIG. 1. Thus, the planks 104 may be coupled to a top cap 106 of each ladder 102, or to one of the rungs 108 of each ladder. As shown in FIG. 2, a series of planks 104 may be used to establish working surfaces at desired elevations along a substantial width or distance. While FIG. 2 shows the use of three ladders 102 and two planks 104, additional components may be added if needed or desired for a given situation. Thus, for example, three planks 104 coupled between four spaced-apart ladders 102 may be used (or five planks 104 with six spaced-apart ladders 102, etc.). Additionally, while FIG. 2 shows the use of two planks 104 at different elevations, the planks 104 could be at the same elevation to provide an extended working surface at a common height or elevation above a supporting surface.

Figure 3A:
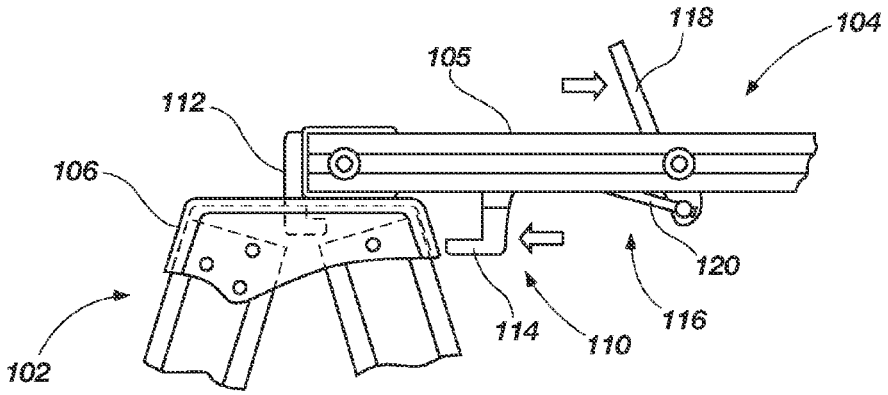
FIGS. 3A-3C are side views of certain portions of the ladder system shown in FIG. 1 during various states of use.
Figure 3B:
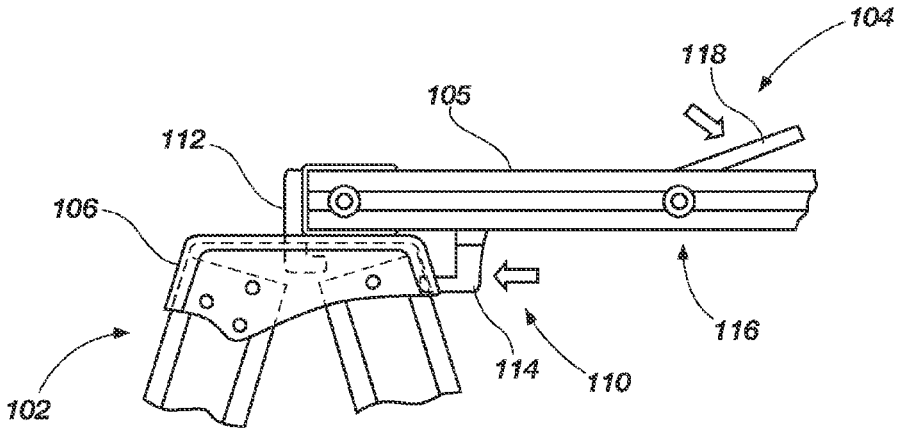
Figure 3C:
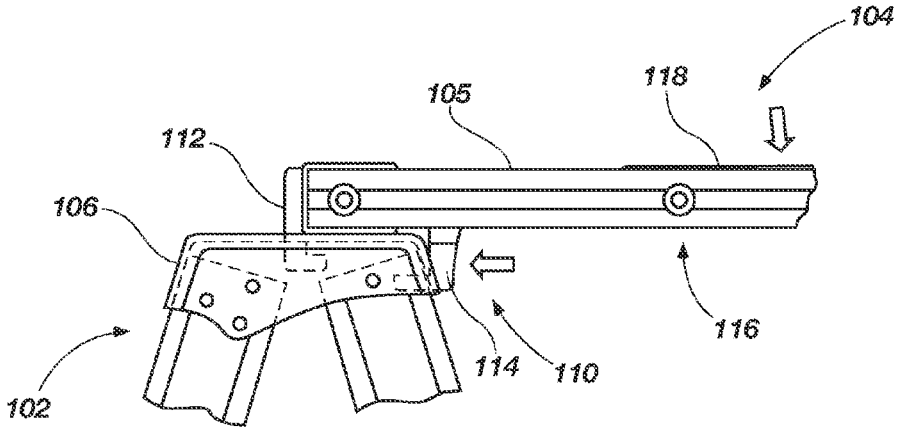

Referring now to FIGS. 3A-3C, an example of a coupling or locking mechanism 110 used to couple a plank 104 with a ladder 102 is shown. The coupling mechanism 110 may include one or more stationary brackets 112 which may be configured as hooks or L-shaped members in one embodiment. The stationary brackets 112 may be coupled to the longitudinal end of the body 105 of the plank 104. In the presently described embodiment, two stationary brackets 112 are located generally at each longitudinal end of the body 105 of the plank 104.

A moveable bracket 114 is moveably coupled with the body 105 of the plank 104 and is configured to move relative to the stationary bracket 112. In one embodiment, the moveable bracket 114 may be slidable relative to the body 105 of the plank 105 between two positions such as described below. An actuator 116 is coupled with the moveable bracket 112 and, in one embodiment, may include a lever 118 that is pivotally coupled with the plank 104, and a linkage member 120 coupled between the lever 118 and the moveable bracket 114.

When the lever 118 is displaced, the movement is transferred through the linkage member 120 to effect displacement of the moveable bracket 114. Thus, as shown in FIGS. 3A-3C, as the lever 118 moves from an "open" position (FIG. 3A) to a "closed" position (FIG. 3C—with FIG. 3B showing an intermediate position of the lever), the moveable bracket 114 is displaced to the left (in the orientation shown in FIGS. 3A-3B) to effect engagement of an associated ladder 102.

Thus, to selectively couple the plank 104 to the top cap 106 of a ladder 102, the moveable bracket 114 is placed in the open position (i.e., as shown in FIG. 3A, or in position H3 shown in FIG. 3), and the stationary brackets 112 are positioned in corresponding holes or slots 124 formed in the top cap 106 of the ladder 104 (see FIGS. 1 and 2). The lever 118 is then displaced and the moveable bracket 114 is correspondingly displaced from an open position to a closed position so as to engage the top cap 106 as indicated in FIG. 3C. One the coupling mechanism 110 has engaged the top cap 106, an affirmative connection is formed such that, if one were to pick up the plank 104, the ladder 102 would remain coupled to the plank 104 and be picked up with the plank 104. It will be understood that a coupling mechanism 110 positioned at each end of the plank 104 enables each end of the plank 104 to be coupled with a separate ladder 102 such as seen in FIGS. 1 and 2.

It is noted that the embodiment shown includes two stationary brackets 112 at each end and a single associated moveable bracket 114. The stationary brackets 112 are spaced apart across a width of the plank 104 with the moveable bracket 114 positioned generally in the center. Such a configuration provides substantial stability with the three brackets (two stationary 112 and one moveable 114) forming a triangle about either the top cap 106 or the rung 108 with which they are engaged. However, other arrangements of the stationary brackets 112 and the moveable brackets 114, including positioning and numbers of brackets, are also contemplated.

The movable bracket 114 may exhibit other configurations in accordance with other embodiments. For example, in one embodiment, the movable bracket 114 may be pivotally coupled with the body 105 of the plank 104 and be selectively positionable between open and closed positions for coupling with an associated ladder 102. In another embodiment, the movable bracket 114 may be displaced longitudinally (i.e., in a direction along the length of the plank 104 as described above with respect to FIGS. 3A-3C) as well as being substantially simultaneously displaced elevationally (i.e., up or down when considering the orientation shown in FIGS. 3A-3C). For example, such may be accomplished using a cam mechanism or actuator in association with the movable bracket 114.

While not specifically shown, the sequence of engaging and coupling a plank 104 with a rung 108 of a ladder 102 is a similar sequence to that which is described above with respect to the top cap 106. The main difference, however, is that the stationary brackets 112, rather than being inserted through holes or slots, simply engage the back and underside of the rung 108. Regardless of whether the plank 104 is coupled with a top cap 106 or a rung 108 of a ladder 102, actuation of the moveable brackets (for engagement or disengagement) is simple and may be effected through single handed operation.

The actuating mechanism 110 may be configured so that, when in a closed or locked position, none of its components are obtrusive to a user of the system 100. Thus, for example, the lever 118 may be depressed or positioned in a recess of the body 105 of the plank 104 so that a user does not inadvertently trip or stumble on it when using the system 100.

The system 100 may be made of components such that the total weight of, for example, two ladders 102 and an attached plank 104, enables a user to pick up the entire system and move it at will, without disassembly or uncoupling of the plank 104 from the ladders 102. In one embodiment, such a system 100 (including two ladders 102 and a plank 104) may weigh approximately 35 pounds or less (e.g., the ladders 102 weighing approximately 10 pounds each, and the plank 104 weigh approximately 15 pounds) with the ladders 102 being approximately 32 inches tall and the plank 104 having a length (extending between the two ladders 102) of approximately 6 feet. In one embodiment, such a configuration could support, for example, 250 pounds or more.

Figure 4A:
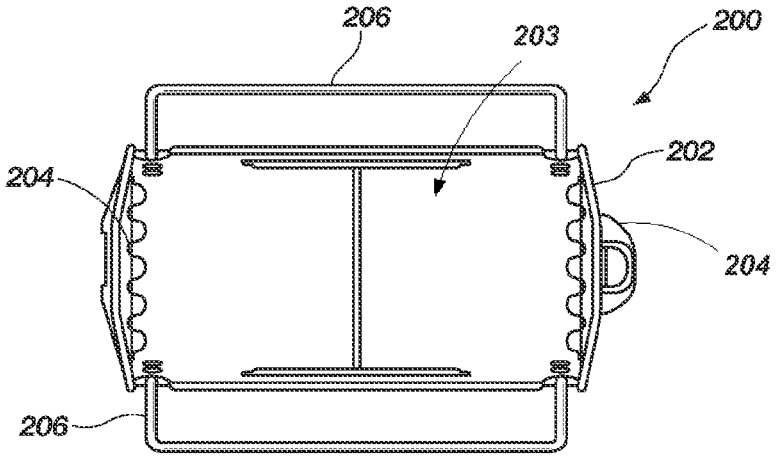
FIGS. 4A-4C are top, front and perspective views of a ladder accessory according to an embodiment of the present invention.
Figure 4B:
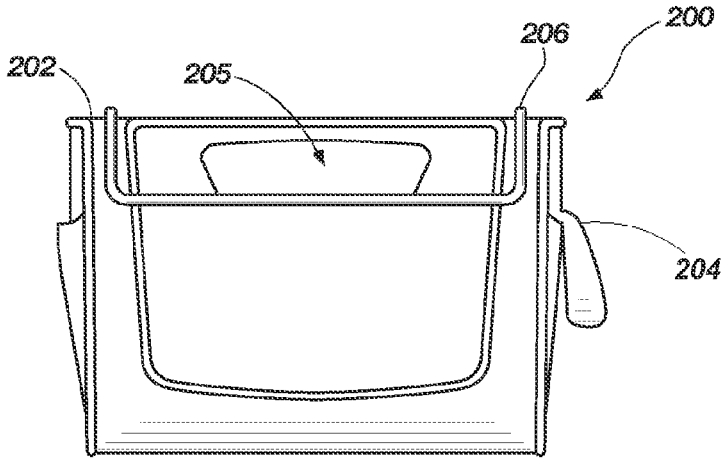
Figure 4C:
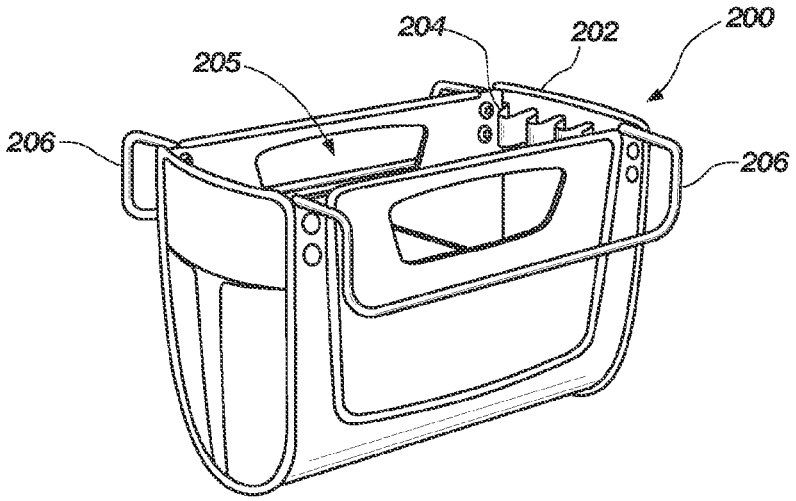

Referring now to FIGS. 4A-4C, a storage device 200 for use with ladders is shown. The storage device 200 includes a main portion 202 that may be formed as a bag or a sack. The main portion 202 defines a volume in which tools, parts, supplies or other resources may be stored while one is working on a ladder. The main portion 202 may be formed of a flexible, collapsible material, such as a durable canvas, nylon or other suitable material. Inside the volume defined by the main portion 202, a plurality of loops 204 may be configured to hold various tools (e.g., screw drivers, pliers, hammers, etc.). In one embodiment, some of the straps may be formed, for example, of an elastic material. However, the straps may be formed of other materials as may be desired. For example, a hammer loop may be formed on the outside of the main portion and formed of a nylon strap or other appropriate material.

Other pockets and pouches may be formed in the interior, or on the exterior, of the main portion. For example, a divider 203 is shown in FIG. 4A which may be used to subdivide the volume of the main portion into multiple zones or areas within the main portion 202. Additionally, One or more handles 205 may also be formed in the main portion 202 for carrying and handling of the storage device 200. While the handles 205 are shown as openings in the main portion 202, handles may be formed as straps, brackets or other structures as appropriate. A pair of brackets 206 are also coupled to the main portion 202 and are configured to be coupled with a portion of a ladder with each bracket 206 being coupled with one side of the main portion 202.

Figure 5:
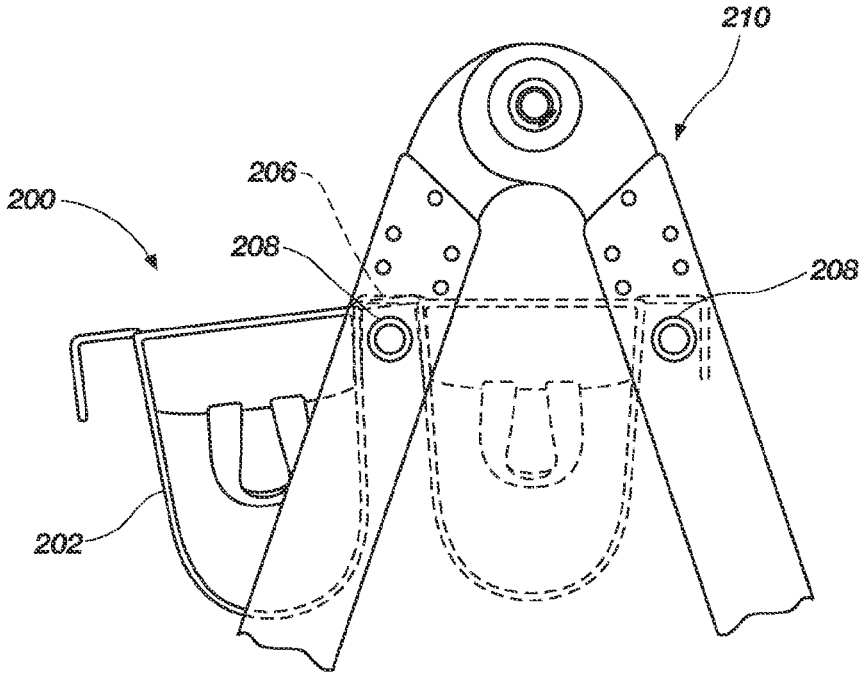
FIG. 5 is a side view of the ladder accessory shown in FIGS. 4A-4C attached to a ladder in one configuration.
Figure 6:
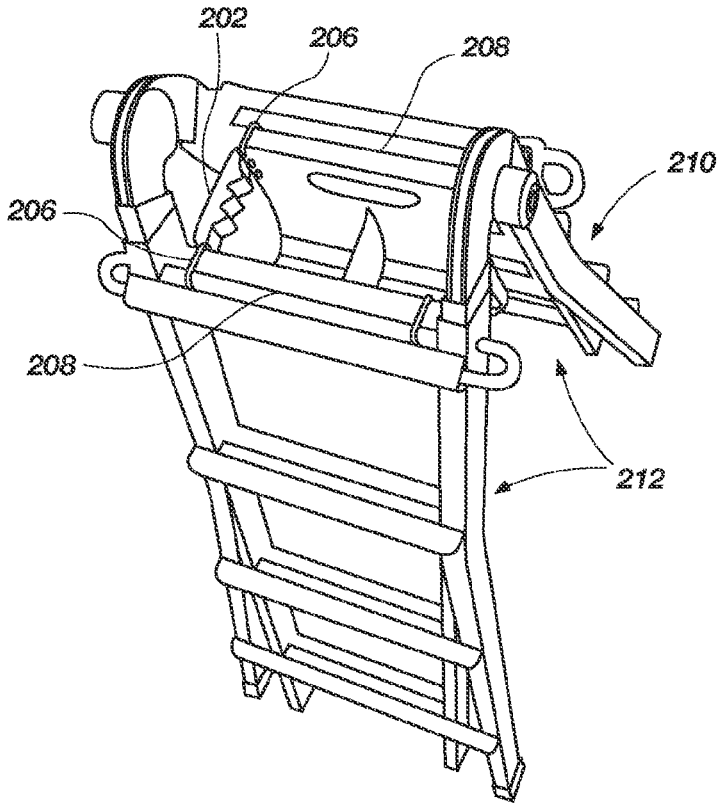
FIG. 6 is a perspective view of the ladder accessory shown in FIGS. 4A-4C attached to a ladder in another configuration.

Referring to FIGS. 5 and 6, the brackets 206 may be configured to engage one or more rungs 208 of a ladder 210. For example, as shown in FIG. 5, the storage device 200 may be configured to hang from a single rung 208 of a ladder 210 on an exterior portion of the ladder 210. Additionally, the storage device 200 may be coupled to adjacent rungs 208 of opposing rung/rail assemblies 212 of, for example, a multipurpose ladder 210 which conventionally lacks a top cap, such as shown in FIG. 6 (and in dashed lines in FIG. 5). Moreover, when coupled with adjacent rungs 208 as shown in FIG. 6, since the main portion 202 is formed of a flexible, collapsible material, the storage device 200 may stay attached to the adjacent rungs 208 when the ladder is folded or collapsed for transportation or storage. Additionally, the top of the main portion 202 may be configured to close and encompass any contents contained therein when it collapses with a folded ladder. In one embodiment, additional structure or mechanisms may be associated with the main portion 202 to keep the top closed. For example, Velcro®, snaps, magnets, zippers or other structures may be used to help keep the top of the main portion 202 closed when the main portion 202 is in a collapsed state.

Figure 7A:
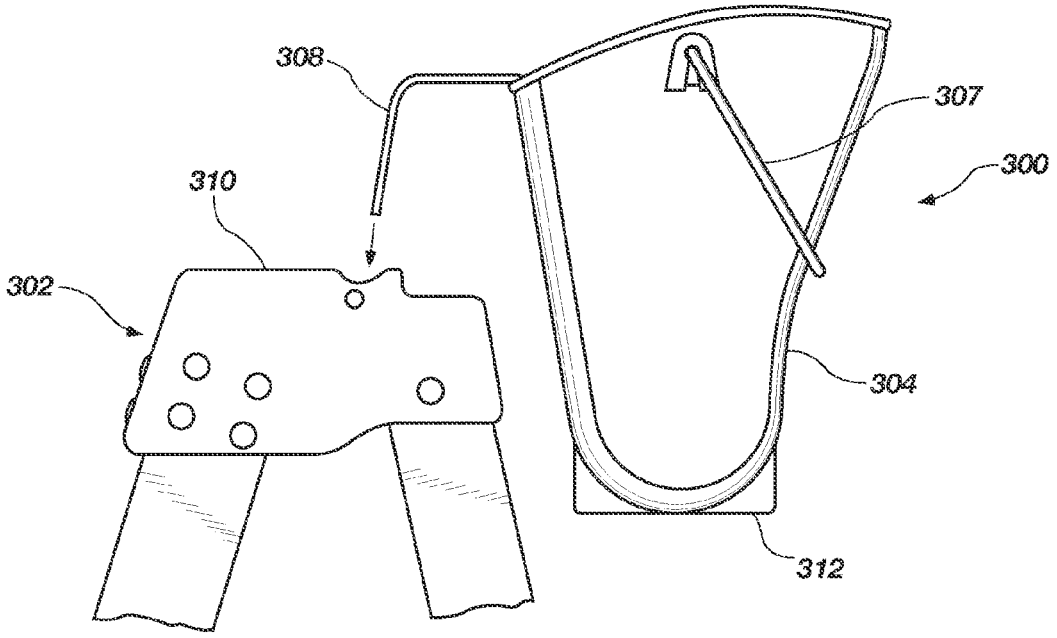
FIGS. 7A-7C are side, back perspective, and top perspective views of a ladder accessory in accordance with another embodiment of the present invention.
Figure 7B:
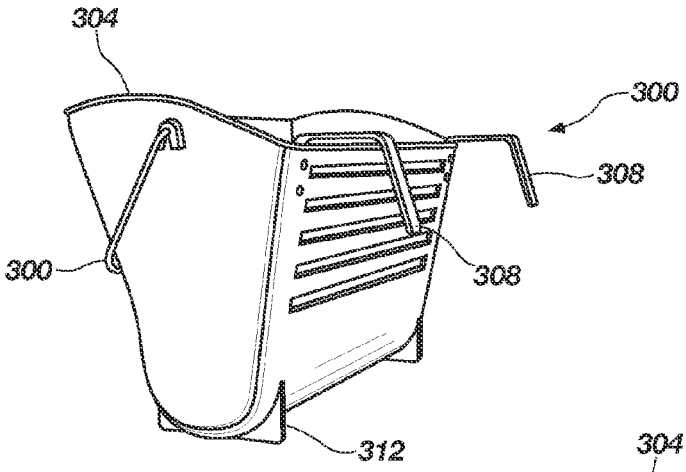
Figure 7C:
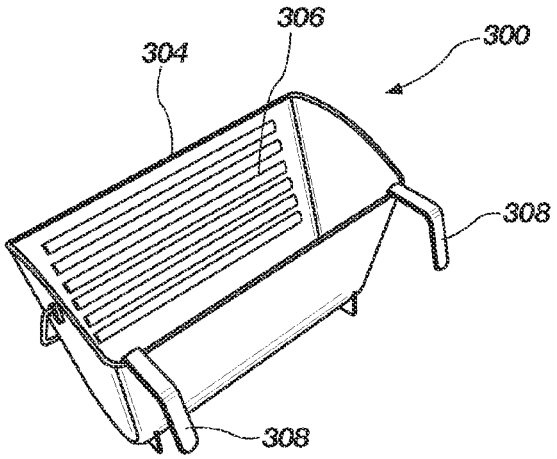

Referring now to FIGS. 7A-7C, a paint tray 300 or container for use with a ladder 302 is shown. The paint tray 300 includes a body portion 304 configured to hold a desired volume of paint. For example, in one embodiment, the body portion 304 may be configured to hold approximately ¾ of a gallon of paint without the concern of spilling out of the paint tray when a paint roller is placed within the body portion 304.

In one embodiment, the body portion 304 is configured to exhibit substantial depth so that a paint roller may be disposed therein and rolled against an interior wall of the body portion 304. Inside the body portion 300, a plurality of protrusions 306 may be formed along a wall thereof to help spread or distribute paint on to paint roller as will be appreciated by those of ordinary skill in the art. A handle 307 is coupled to the body portion 304 for carrying and handling of the paint tray 300.

One or more brackets 308 are coupled with the body portion 304. In one embodiment, the brackets 308 are configured to cooperatively engage corresponding slots or openings in the top cap 310 of a ladder 302. Thus, for example, the paint tray 300 may be coupled on the back side of a ladder 302, by way of the top cap 310, so that a user may stand on the ladder 302 and access the paint tray 300 over the top of the ladder 302 while painting (see FIG. 7A). The main body portion 304 also includes a base portion 312 which is configured to support the paint tray 300 on a supporting surface (e.g., the ground, a table, a plank, etc.) without added assistance.

Figure 8A:
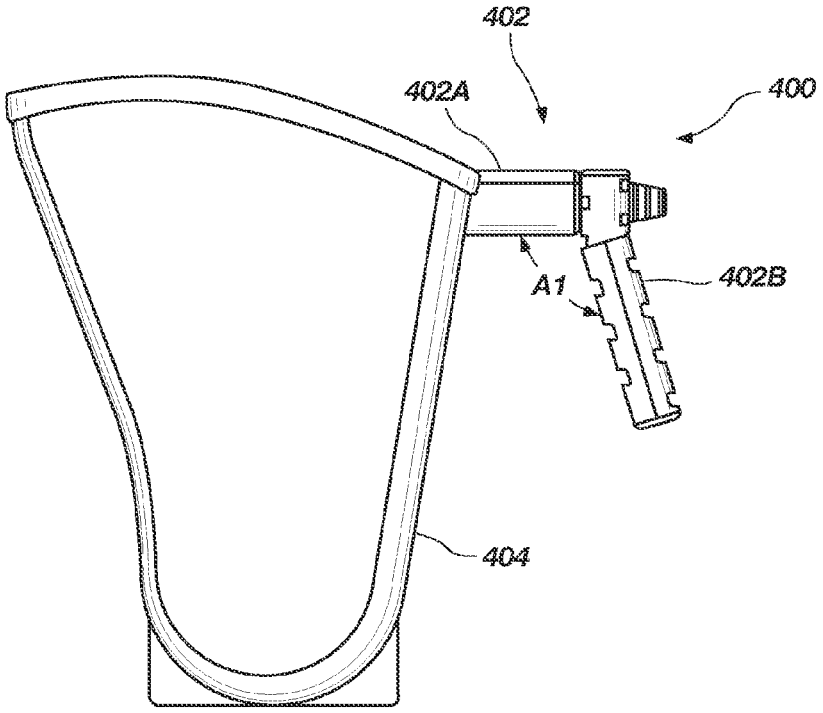
FIGS. 8A and 8B show another embodiment of a ladder accessory.
Figure 8B:
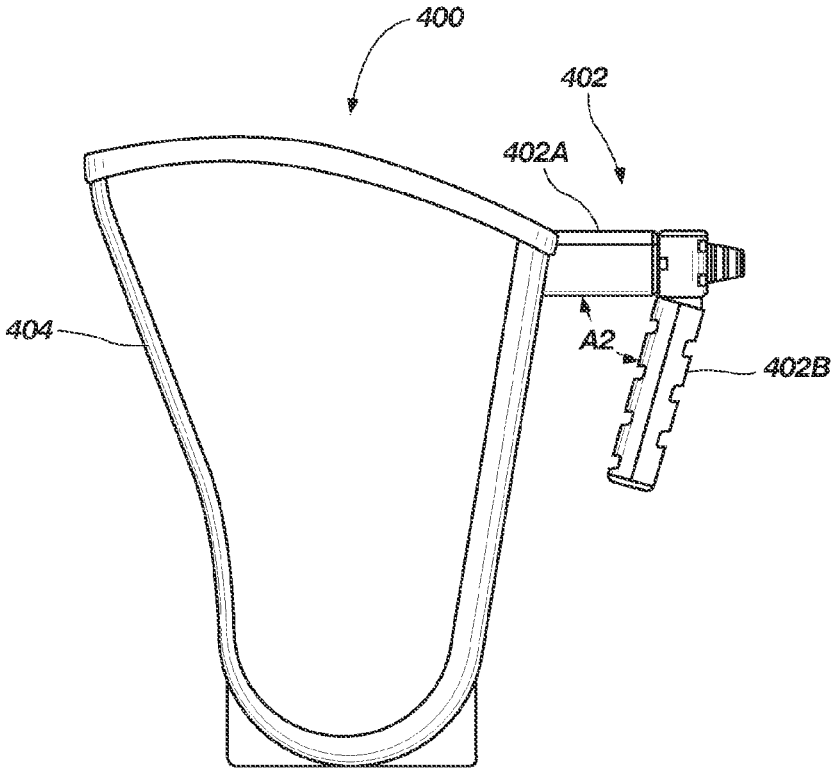

Referring to FIGS. 8A and 8B, another embodiment of a paint tray 400 is shown. The paint tray 400 is similar to the paint tray 300 shown and described with respect to FIGS. 7A-7C, but has selectively adjustable brackets 402. The brackets 402 include a first portion 402A coupled to the main body 404. A second portion 402B is selectively coupled with the first portion 402A. In one embodiment, the first portion 402A of the bracket may be integrated with the main body portion 404 and the second portion 402B of the bracket.

Figure 9:
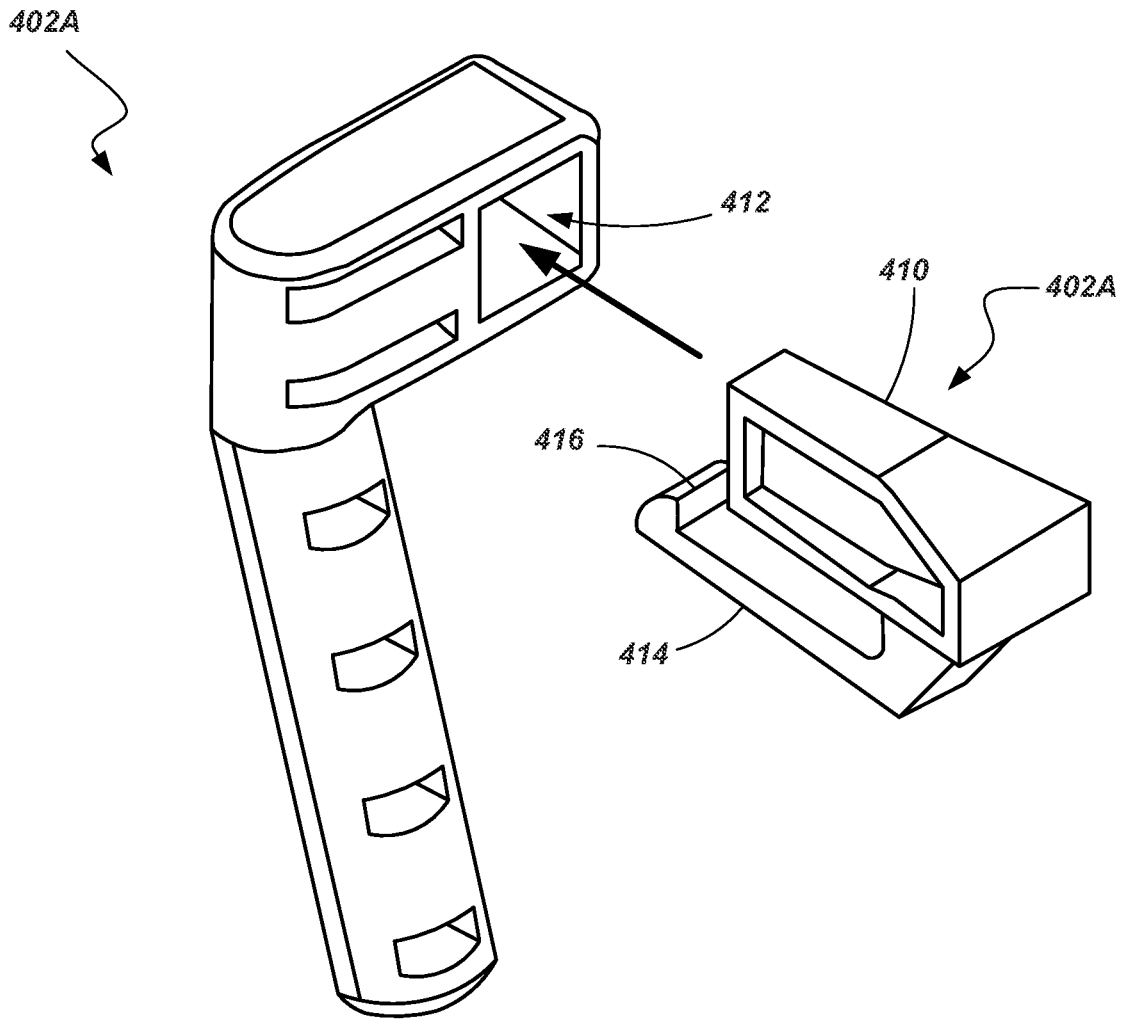
FIG. 9 is an explode view of certain components of the ladder accessory shown in FIGS. 8A and 8B.

In another embodiment, the first portion 402A of the bracket may be separate from, and removably coupled with, a portion of the main body 404. For example, FIG. 9 shows and example of first and second portions 402A and 402B which may be used in conjunction with the paint tray 400. The first portion 402A may include a first body portion 410 configured to extend through an opening 412 of the second portion. The first portion 402A may also include a latching or securing portion 414 for coupling with the main body 404 of the paint tray 400. For example, the latching portion 414 may have a lip 416 configured to extend within an opening within the main body 404 (or within a bracket formed on, or coupled to, the main body). The latching portion 414 may be biased such that the lip 416 abuts a peripheral wall of an opening associated with the main body 404.

Still referring to FIGS. 8A and 8B, when coupled together in a first manner, such as shown in FIG. 8A, the second portion 402B of the bracket forms an angle A1 relative to the first portion 402A of the bracket, which angle A1 may be described as being obtuse or greater than 90° enabling the paint tray 400 to be securely coupled with the top cap of a ladder (e.g., such as shown in FIG. 7A). When coupled in a second manner, such as shown in FIG. 8B, the second portion 402B forms a different angle A2 relative to the first portion 402A which may be described as being acute or less than 90° and which enables the paint tray 400 to be securely coupled with the rung of a ladder. This enables the paint tray to be used effectively with a variety of different types and models of ladders. For example, the paint tray may be utilized in conjunction with step ladders, extension ladders, straight ladders and combination ladders.

It is also noted that the second portion 402A of the brackets may have ribs, ridges, channels or other surface features 418 formed thereon. Such surface features 418 may be configured to engage certain components or structures of a ladder. Thus, for example, channels may be formed so as to engage a portion of a top cap or a ladder rung to enhance security and stability of the paint tray 400 when coupled with a ladder.

Figures 10A, 10B, 10C:
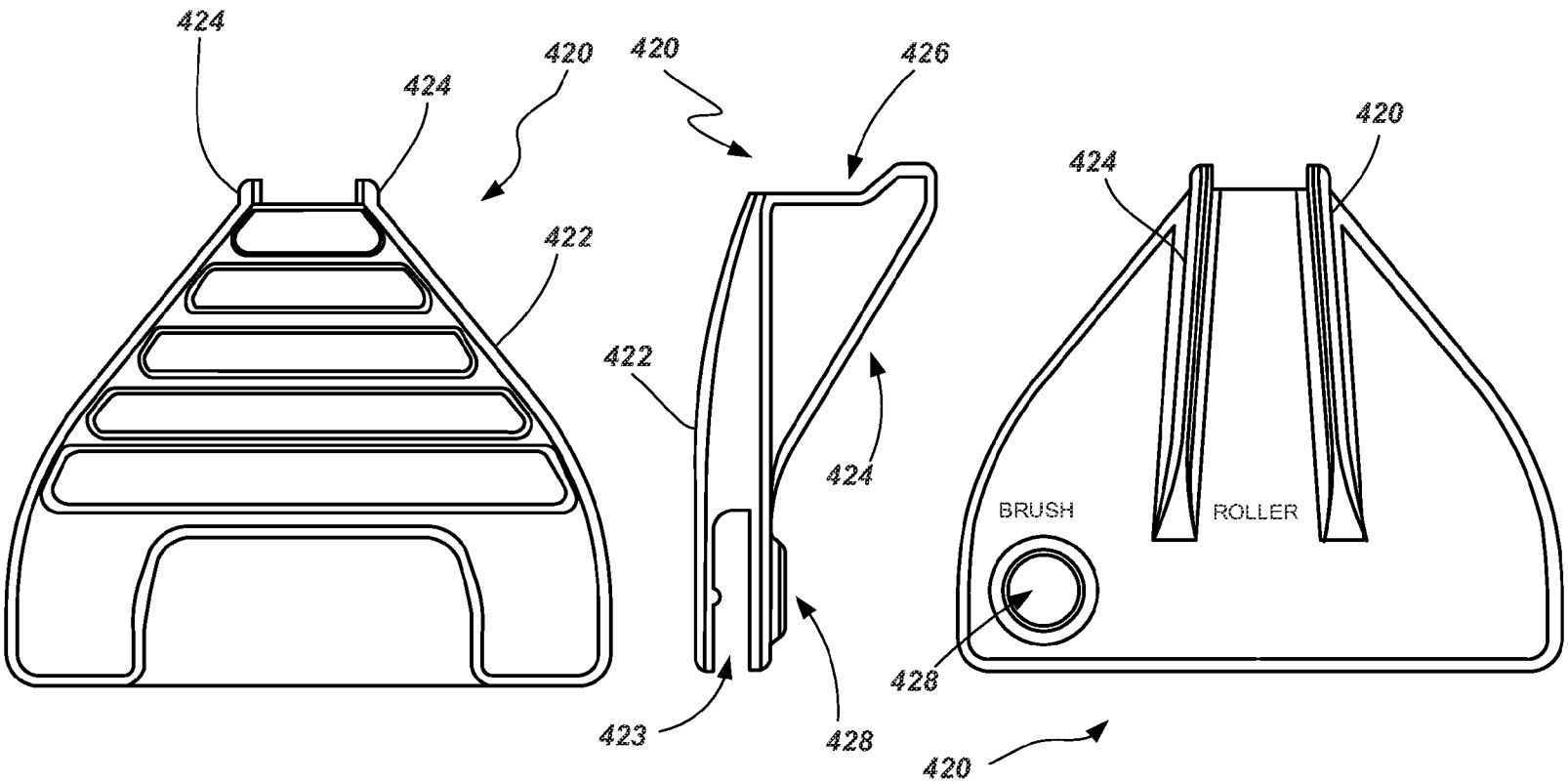
FIGS. 10A-10C are back, side and front views of another embodiment of a ladder accessory that may be used in conjunction with the accessories shown in FIGS. 7A-7C, 8A and 8B.

Referring to FIGS. 10A-10C, a holder 420 is shown that may be coupled with the paint tray 400 (or paint tray 300). In one embodiment, the holder 420 includes a body portion 422 having a slot 423 or other structure defined at a lower end thereof, for example, for coupling with the main body 404 of the paint tray 400. For example, the slot 423 may be positioned over the upper edge of a wall forming the main body 404 such that the body portion 422 of the holder 420 effectively extends upward from the wall of the paint tray 400. The holder 420 includes structure such as a pair of spaced-apart bracket arms 424 protruding or extending from a face of the body portion 422. The arms 424 are positioned and configured so that a paint roller may be placed along the top edges 426 of the arms 424 with the handle of the paint roller being positioned against body portion 422 between the two arms 424. The holder 420 may also include a bracket or other structure for holding a brush. For example, a magnet 428 may be coupled with the body portion 422 so that the metal casing of a paint brush may be placed adjacent the magnet 428 to hold the paint brush against the face of the body portion 422.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A paint tray for use with multiple ladders, the paint tray comprising:

a body portion defining a volume and being configured for direct containment of a liquid therein; and a pair of spaced apart brackets, each bracket respectively including:

a first portion having a first end, a second end, and a latching member, the first end being coupled directly to the body portion; and a second portion having a first section and an opening formed in a second section, wherein the first section extends generally downward when the paint tray is in an upright orientation of intended use, wherein the second section extends in a generally lateral direction relative to the first section, wherein the opening is sized and configured for selective coupling with the first portion between at least two different positions, wherein the latching member is sized and located to latch the second section to the first portion upon inserting the second end of the first portion a desired distance through the opening, wherein the at least two different positions include a first position and a second position, wherein an acute angle is formed between the first section and a defined plane extending through the first portion when in the first position, wherein an obtuse angle is formed between the first section and the defined plane extending through the first portion when in the second position, wherein the first and second positions are configured to be switched back and forth as a direct result of removing the first portion from the opening, flipping the second portion 180 degrees, and then inserting the second end of the first portion into an opposite side of the opening.

2. The paint tray of claim 1, wherein, when the second portion of each bracket is in its first position, the pair of brackets are oriented and configured for removable coupling with a first component of a ladder and, when the second portion of each bracket is in its second position, the pair of brackets are configured for removable coupling with a second component of the ladder.

3. The paint tray of claim 2, wherein the first component of the ladder includes a top cap of the ladder and wherein the second component of the ladder includes a rung of the ladder.

4. The paint tray of claim 1, wherein the volume is configured to hold at least approximately ¾ of a gallon.

5. The paint tray of claim 1, wherein the first portion of each bracket is integrally formed with the body portion.

6. The paint tray of claim 1, wherein the first section of the second portion of each bracket includes one or more surface features from the group consisting of ribs, ridges and channels.

7. The paint tray of claim 1, wherein, in each bracket respectively, the opening is offset laterally relative to the first section when the paint tray is in the upright orientation of intended use.

* * * * *